United States Patent [19]

Mayo

[11] 4,048,946

[45] Sept. 20, 1977

[54] ANCHOR WITH INDEPENDENT PAIRS OF FLUKES

[76] Inventor: Henry C. Mayo, 8319 Midwood St., Alexandria, Va. 22308

[21] Appl. No.: 721,642

[22] Filed: Sept. 8, 1976

[51] Int. Cl.[2] ..... B63B 21/24

[52] U.S. Cl. ..... 114/307; 114/306

[58] Field of Search ..... 114/294, 295, 297, 298, 114/299, 301, 302, 303, 304, 305, 306, 307, 308, 309, 310

[56] References Cited

U.S. PATENT DOCUMENTS

| | | | |
|---|---|---|---|
| 481,782 | 8/1892 | Chrietzberg | 114/310 |
| 2,053,838 | 9/1936 | Lundin | 114/307 |
| 3,022,761 | 2/1962 | DeBeixedon | 114/306 |
| 3,306,248 | 2/1967 | Austin | 114/304 |

FOREIGN PATENT DOCUMENTS

| | | |
|---|---|---|
| 395 | 7/1906 | United Kingdom |

*Primary Examiner*—Trygve M. Blix
*Assistant Examiner*—D. W. Keen
*Attorney, Agent, or Firm*—Nathan Edelberg

[57] ABSTRACT

An anchor construction wherein two pairs of independently operating flukes are pivotally mounted at one end of an elongated shank. Each fluke of the primary pair of flukes lies on an opposite side of the shank and each fluke of the secondary pair of flukes lies on an opposite side of the primary flukes. Means are provided to simultaneously establish a relatively small angle between the primary flukes and the shank and a relatively large angle between the secondary flukes and the shank. This capability permits the anchor to be used interchangeably in either hard or soft bottom sediments without human intervention to reset fluke angles.

6 Claims, 4 Drawing Figures

ANCHOR WITH INDEPENDENT PAIRS OF FLUKES

GOVERNMENT USE

The invention described herein may be manufactured, used, and licensed by or for the Government for Governmental purposes without the payment to me of any royalties thereon.

BACKGROUND OF THE INVENTION

The invention relates to ship or mooring type anchor constructions for mooring floating structures. The invention further relates to salvage type anchors which provide dead-man type resistance for dragging a disabled ship or other structure along the bottom of a body of water. It relates particularly to anchors having two pairs of independently operating flukes.

DESCRIPTION OF THE PRIOR ART

Heretofore anchor constructions have made use of a single pair of anchor flukes operating at an optimum angle with respect to a centrally disposed shank as in U.S. Pat. No. 3,015,299. Such anchors are at a disadvantage for general use in varied ocean-bottom sediments because the angle between the flukes and the shank which provides optimum anchor holding power in harder sediments such as sand will not provide optimum holding power in softer sediments such as mud. Even anchors which provide means for adjustment of the fluke angle are cumbersome and impractical for use in the field since the proper fluke angle has to be determined by a trial and error procedure during employment of the anchor. Anchors devised with a pair of flukes wherein each fluke is at a different angle with respect to the shank are unsatisfactory because of instability and excessive drag distance to set the anchor. Another approach that has been tried is to construct anchors having two pairs of flukes. One form of construction utilizing two pairs of flukes is illustrated in British Pat. No. 395 issued in 1906. The anchor construction of this British patent utilized a pair of primary flukes having a tripping member that was mounted to the shank so as to freely pivot through a first angle, and a pair of smaller secondary flukes that were mounted to freely move through second larger angle. This anchor construction is unsatisfactory because the secondary flukes in practice would swing upwardly out of contact with ocean bottom due to the absence of a crown assembly or other means to restrict such movement. An alternate anchor construction utilizing two pairs of flukes is shown in U.S. Pat. No. 481,782 issued in 1892. In this patent the secondary flukes are mounted in fixed relationship to the primary flukes and consist of a mirror-imaged set of prongs, only one of which is intended to engage depending upon direction of drag upon the anchor. This anchor construction is unsuitable because the upper prong, which does not enter the bottom, acts to impede penetration of the main flukes and thus limits the holding power of the anchor. An anchor constructed for optimum performance in both hard and soft bottom sediments is essential for efficient and economical field operations because of the variable and unpredictable nature of ocean sediments and the time and expense required to obtain satisfactory information and, due to the above noted inadequacies of the prior art anchors, this need has gone unfulfilled until the present invention.

SUMMARY OF THE INVENTION

This invention is directed to an anchor construction wherein two pairs of independently operating flukes are pivotally mounted at one end of an elongated centrally disposed shank. Each fluke of the primary pair of flukes lies on an opposite side of the shank and each fluke of the secondary pair of flukes lies on an opposite side of the primary flukes. The flukes are fitted with crown assemblies which have laterally projecting stabilizer arms to prevent deflection of the flukes and assist their penetration of the ocean bottom. In operation, the anchor is dragged horizontally along the ocean bottom by pulling on the other end of the shank. The primary flukes penetrate the bottom sediments and assume a certain angle with respect to the shank for optimum holding power in harder sediments. The secondary flukes also penetrate the bottom sediments but assume an angle with respect to the shank for optimum holding power in softer sediments.

OBJECTS OF THE INVENTION

It is an object of this invention to provide an anchor construction which incorporates independently operating pairs of flukes permitting optimum holding power in both hard and soft sediments without resorting to manually modifying the anchor structure.

Another object of this invention is to provide an anchor construction in which a primary pair of flukes pivots about the anchor shank to assume a certain angle relative to the shank which is optimum for harder sediments and in which the secondary pair of flukes pivots about the shank to assume a certain different angle relative to the shank which is optimum for softer sediments.

Still another object of the invention is to provide an anchor assembly which does not require trial-and-error procedures during field use to determine the optimum fluke angle for the sediments at a particular site.

A further object of the invention is to provide an anchor suitable for efficient use for mooring ships, vessels, or other floating structures at offshore locations, for use in a dead-man type arrangement while dragging or changing the position of sunken vessels or other disabled floating structures, and for dragging or pulling objects from a location on the beach into the water to a position offshore.

Another object of the invention is to provide an anchor comprising more than one pair of flukes pivoting about one end of an elongated centrally disposed shank, where each fluke is fitted with a crown assembly, where a lateral stabilizing arm extends from each outer crown assembly, and where stopping means are provided to control the angles assumed by the anchor flukes relative to the shank.

The above and still further objects, novel features, and advantages of the present invention will become apparent upon consideration of the following detailed description of one specific embodiment thereof, especially when considered in conjunction with the accompanying drawings.

DESCRIPTION OF THE PREFERRED EMBODIMENT

Figure 4:
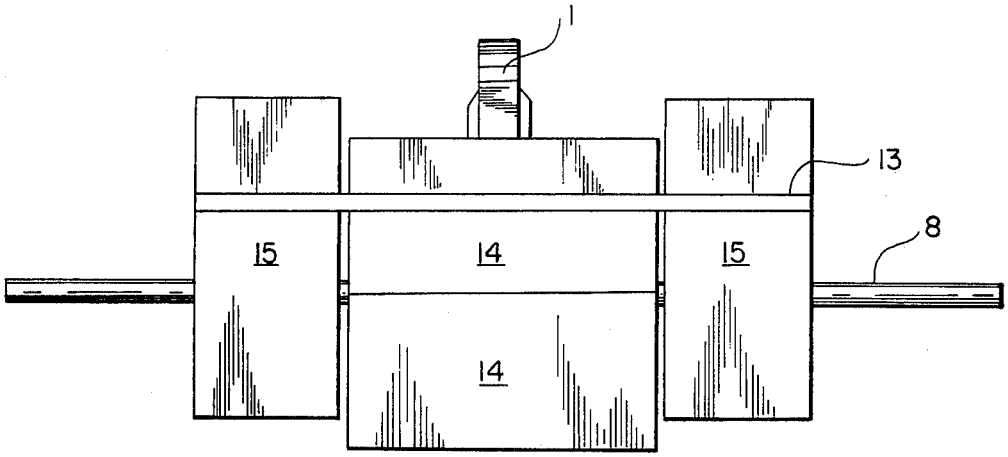
FIG. 4 is a side or rear view of the structure shown in FIG. 1.
Figure 1:
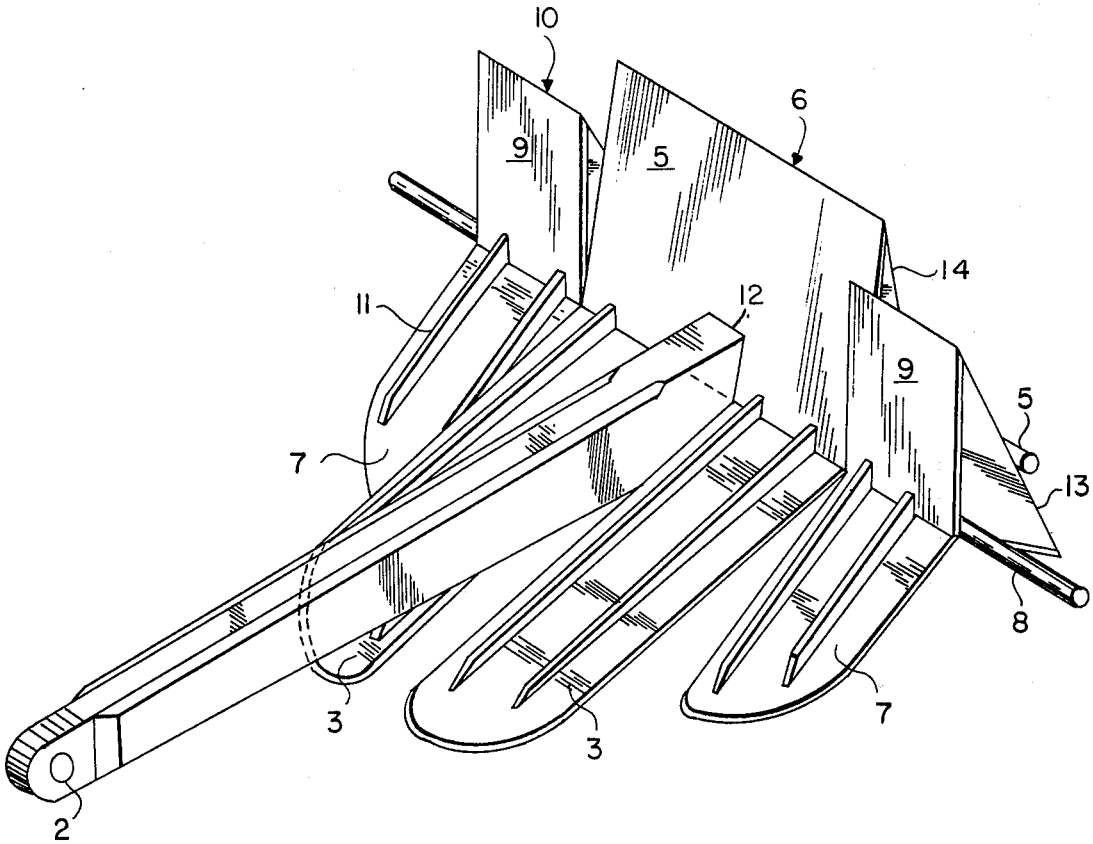
FIG. 1 is an isometric view of the anchor of this invention.
Figure 2:
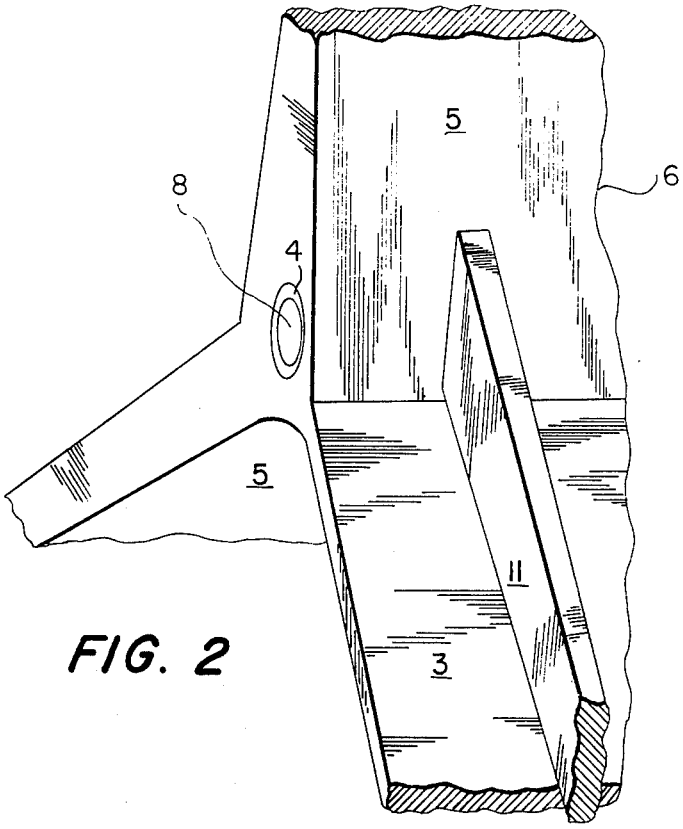
FIG. 2 is an enlarged perspective view of the primary crown assembly.
Figure 3:
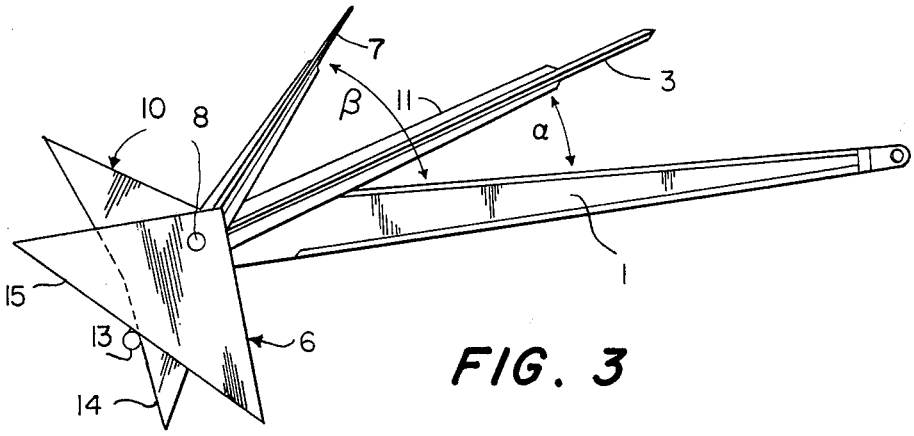
FIG. 3 is an elevation view of the structure shown in FIG. 1.

Referring to the drawings in detail, there is illustrated an anchor with independent pairs of flukes which includes an elongated centrally disposed shank 1 having a shackle engaging eye 2 located at one end and two pairs of substantially flat flukes pivotally mounted at the other end. The primary pair of flukes 3 lie on opposite sides of shank 1 and are supported on a primary journaled trunnion bar 4 best illustrated in FIG. 2. The primary trunnion bar 4 lies within the oppositely directed flat tripping plate surfaces 5 of the primary crown assembly 6. The details of a suitable journal arrangement are described in prior U.S. Pat. No. 3,015,299 and, therefore, are not repeated here. The secondary pair of flukes 7 lie on opposite sides of the primary flukes 3 and are supported on a secondary trunnion and stabilizing bar 8 which passes inside the primary trunnion bar 4. The bar 8 also extends laterally outward from each secondary fluke 7 a sufficient distance to prevent rotation of the anchor about the axis of the shank 1. The primary trunnion bar 4 serves as a journal for the secondary bar 8. The secondary bar 8 lies within the oppositely directed flat tripping plate surfaces 9 of the secondary crown assembly 10. The primary crown assembly is rigidly affixed to the primary flukes 3 and the secondary crown assembly 10 is likewise rigidly affixed to the secondary flukes 7. Reinforcing ribs 11 are fitted to the flukes 3 and 7.

The primary flukes 3 are free to pivot about the axis of trunnion bar 4 relative to the shank 1 until the stopping surface 12 at the fluke end of the shank 1 makes contact with the tripping plate 5. When this contact takes place, the primary flukes 3 form a certain angle $\alpha$ with the opposite side of the shank 1. This angle is variable, but it has been found that the angle preferably should be no more than about 34°. If the anchor is utilized in the upside down orientation, the primary flukes are free to pivot to permit the opposite side of the flukes to form the same angle with the opposite side of the shank 1.

The secondary flukes 7 are free to pivot about the axis of the trunnion bar 4 relative to the shank 1 until the stopping bar 13 makes contact with the primary rear crown plate 14. The stopping bar 13 is rigidly attached to each secondary rear crown plate 15. The bar 13 extends laterally between the secondary rear crown plates 15. When contact occurs between the stopping bar 13 and the primary crown plate 14, the secondary flukes 7 form a certain angle $\beta$ relative to the shank 1. This angle is necessarily greater than the angle $\alpha$ formed between the primary flukes 3 and the shank 1 as described above and is preferably not more than about 50°. The secondary flukes 7 are also free to pivot relative to the shank 1 when the anchor is in the upside down configuration in a fashion similar to that heretofore described for the primary flukes.

The stabilizing bars 8 may also be hingedly mounted on the outer edge of each secondary fluke. A suitable hinge arrangement is shown in prior U.S. Pat. No. 3,527,187 and therefore is not repeated here.

OPERATION OF AN EMBODIMENT OF THIS INVENTION

For operation, the anchor is typically fastened to a heavy chain by means of a shackle connection to the eye 2 in the shank 1. The anchor is placed on the sea bottom by a suitable means, as a floating vessel. Since the flukes 3 and 7 can pivot in either direction relative to the shank 1, special care does not have to be exercised when placing the anchor on the bottom. When the anchor comes to rest on the bottom, the stabilizing bar 8 and the shank 1 are in a substantially horizontal position.

The anchor develops holding power when it is dragged along the bottom by the chain attached to the eye 2 of the shank 1. The action of the dragging causes the tips of the flukes 3 and 7 to penetrate into the bottom sediments. The penetration of the flukes 3 and 7 is aided by the forces of the sediment against the lower portion of the tripping plates 5 and 9 of the crown assemblies 6 and 10. After being dragged a short distance, the anchor becomes completely submerged in the sediments and develops its rated holding power.

Experience and testing has shown that fluked anchors require a relatively smaller fluke to shank angle for harder sediments and a relatively large fluke to shank angle for softer sediments. In conventional anchors a provision is incorporated wherein the fluke angle can be manually changed, as by means of a removable wedge, fitted to the shank stop 12. In this invention, such a wedge device and such manual intervention are unnecessary because of the use of independent pairs of flukes.

In the case of a harder bottom, the present invention makes use of the primary flukes 3 which are longer and set at a smaller fluke to shank angle than that of the secondary flukes 7. This arrangement for the primary flukes 3 insures that they will touch the bottom and ungergo initial penetration into the bottom sediments before the secondary flukes engage the bottom. The secondary flukes 7, with a larger fluke to shank angle, eventually also penetrate the sediments to provide additional holding power. However, the initial penetration of the primary flukes 3 prevents rotation of the anchor and loss of penetration which occurs for conventional anchors in harder bottoms when the fluke to shank angle is too great. It should be noted that this operation is the direct opposite of that recited in the above noted British Patent and U.S. Pat. No. 481,782. This difference in the penetration order is attributable to the presence of the crown assemblies on the anchor of the present invention.

In the case of the softer bottom, the present invention makes particular use of the secondary flukes 7 which are shorter and situated at a greater fluke to shank angle than that of the primary flukes 3. Since the bottom sediments are soft, the primary flukes settle down into the sediments and permit the secondary flukes 7 to engage the sediment immediately. The action of secondary flukes 7 causes the anchor to penetrate the sediments quickly and develop maximum holding power in minimum drag distance. When a conventional fluked anchor is utilized in softer sediments, the fluke to shank angle is very likely to be set at too small an angle. This prevents the conventional anchors from properly penetrating into the sediments and results in very inferior anchor holding power.

As is now readily apparent, I have provided an anchor with independent pairs of flukes that gives the advantage of optimum performance in either relatively hard or relatively soft ocean bottom sediments without the necessity of adjusting fluke angles in the field to be commensurate with the type of sediments encountered. The increase in ease, reliability and efficiency of anchoring that is accomplished thereby fulfills a long recognized need.

I claim:

1. In an anchor of the type having a shank, a set of primary flukes pivotally mounted on opposite sides of one end of the shank, and a set of secondary flukes of a length less than the length of said primary flukes mounted on the same sides of said shank as the primary flukes, the improvement comprising:

a. a first crown assembly including tripping and rear crown plates affixed to the primary flukes as an extension thereof;

b. a second crown assembly including tripping and rear crown plates affixed to each of the secondary flukes as an extension thereof;

c. stopping surfaces on said one end of the shank which contact said first crown assembly when said flukes are pivotally rotated a fixed number of degrees to either side of said shank;

d. stopping means attached to the second crown assemblies in a position such that they engage a surface on said first crown assembly when said second crown assemblies are rotated a prescribed number of degrees relative to said first crown assembly wherein said fixed angle and said prescribed angle are such that the secondary flukes will form a larger angle with respect to said shank than said fixed angle.

2. The anchor of claim 1 wherein said fixed angle is approximately 34° And said larger angle is approximately 50°.

3. The anchor of claim 1 wherein said stopping means is a bar extending between the rear crown plates of said second crown assembly and said surface of said first assembly is a pair of sloped walls.

4. The anchor or claim 3 wherein said position is on the rear side of each rear crown plate of the second crown assembly and said surface engaged by said stopping means is a rear surface.

5. The anchor of claim 1 wherein said secondary flukes are mounted outwardly of said primary flukes.

6. The anchor of claim 5 further comprising stabilizing bars extending outwardly from said second crown assembly on both sides of said shank.

* * * * *